US008960058B2

(12) United States Patent
Lai

(10) Patent No.: US 8,960,058 B2
(45) Date of Patent: Feb. 24, 2015

(54) TORQUE ADJUSTMENT DEVICE FOR SCREWDRIVER

(71) Applicant: Jin Tsai Lai, Tainan (TW)

(72) Inventor: Jin Tsai Lai, Tainan (TW)

( * ) Notice: Subject to any disclaimer, the term of this patent is extended or adjusted under 35 U.S.C. 154(b) by 0 days.

(21) Appl. No.: 13/905,147

(22) Filed: May 30, 2013

(65) Prior Publication Data

US 2014/0352502 A1 Dec. 4, 2014

(51) Int. Cl.

| | |
|---|---|
| ***B25B 23/157*** | (2006.01) |
| ***B25B 23/142*** | (2006.01) |
| ***B25B 15/02*** | (2006.01) |
| *B25B 23/14* | (2006.01) |

(52) U.S. Cl.

CPC ..... *B25B 23/1427* (2013.01); *B25B 15/02* (2013.01); *B25B 23/141* (2013.01)

USPC ..... 81/475; 81/467; 81/473

(58) Field of Classification Search

CPC .. B25B 23/157; B25B 23/141; B25B 23/1427

USPC ..... 81/467, 473–475

See application file for complete search history.

(56) References Cited

U.S. PATENT DOCUMENTS

| | | | | | |
|---|---|---|---|---|---|
| 3,001,430 | A * | 9/1961 | Cranford | 81/474 |
| 4,063,474 | A * | 12/1977 | Klopping | 81/474 |
| 4,901,610 | A * | 2/1990 | Larson et al. | 81/473 |
| 5,239,875 | A * | 8/1993 | Stasiek et al. | 73/862.23 |
| 5,535,867 | A * | 7/1996 | Coccaro et al. | 192/56.1 |
| 5,576,501 | A * | 11/1996 | Huang | 73/862.23 |
| 6,155,147 | A * | 12/2000 | Dzieman | 81/473 |
| 7,383,756 | B1 * | 6/2008 | Liu | 81/467 |
| 7,810,416 | B2 * | 10/2010 | Cutler et al. | 81/467 |
| 8,141,463 | B2 * | 3/2012 | Lai | 81/475 |
| 8,408,104 | B2 * | 4/2013 | Lin | 81/475 |
| 8,443,699 | B2 * | 5/2013 | Ha | 81/57.31 |
| 2014/0137710 | A1 * | 5/2014 | Hsieh | 81/473 |

* cited by examiner

*Primary Examiner* — Monica Carter
*Assistant Examiner* — Danny Hong

(57) ABSTRACT

A torque adjustment device for a screwdriver includes a tube located in the handle of the screwdriver and has an adjusting member connected to the first end thereof, a cap is connected to the second end of the tube. A first block and a second block are connected with each other by engagement of the teeth on the two blocks. A spring is biased between the first block and the adjusting member. A link is connected to the cap which pushes a pushing member to move the second block toward the first block when using an assistance tool to rotate the cap. The first block is able to move toward the second block by rotating the adjusting member so as to change the matching force between the teeth of the blocks. The cap has digits and marks to acknowledge the user the setting value of the torque.

9 Claims, 8 Drawing Sheets

TORQUE ADJUSTMENT DEVICE FOR SCREWDRIVER

FIELD OF THE INVENTION

The present invention relates to a torque adjustment device, and more particularly, to a torque adjustment device received in a handle of a hand tool such as a screwdriver. The output torque is adjusted by rotating the cap at the rear end of the handle.

BACKGROUND OF THE INVENTION

The conventional screwdriver has a handle and a shank which is fixed to the handle. The output torque is not adjusted. However, for some objects, the torque that is applied to the object is set within a specific range and the threads of the object can be broken if the torque is exceeded over the pre-set range. A torque adjustable screwdriver is disclosed in Taiwan Utility Model No. M306166 and comprises a handle, a torque member, a transmission device, a stop and a cap. The torque member has a resilient member and a slide wherein the resilient member is located in the space of the handle and the slide has grooves with which the ridges of the handle are engaged, so that the slide is movable along the ridges of the handle and stopped by the stop. The transmission device has a transmission member and a driving rod which is connected to the transmission member. The driving rod has a driving end which extends through the hole of the slide, the torque member and the hole in the handle. The transmission member has a face which is located corresponding to the guide face of the slide. The driving rod and the transmission member each has a positioning portion at the tow respective facing ends. The output torque is adjusted when the cap is rotated. However, the adjustment cannot be observed by the user when adjusting the torque, so that the user has to set the times of revolutions of the cap each time of use. This is inconvenient and has low efficiency. The torque cannot be micro-adjusted. Besides, when using the screwdriver, shaking may be transferred to the parts in the screwdriver and the parts can be loosened, such that the torque cannot be set precisely.

The present invention intends to provide a torque adjustment device for a screwdriver and the torque adjustment device is micro-adjustable and the parts of the device are well positioned to improve the shortcomings mentioned above.

SUMMARY OF THE INVENTION

The present invention relates to a torque adjustment device for a screwdriver and comprises a tube having an inner threaded hole defined in the first end thereof, and a room is defined in the second end of the tube. The tube has an inner threaded portion defined in the inner periphery thereof. A polygonal passage is defined in the tube and located between the room and the inner threaded hole. A first slot and a second slot are respectively defined through the tube and communicate with the room.

A resilient plate is located in the first slot and a protrusion extends angularly from the first end of the resilient plate. A hole is defined through the second end of the resilient plate. A first bolt extends through the hole of the resilient plate and a second bolt is located in the second slot of the tube.

An adjusting member is connected to the first end of the tube and has an outer threaded portion which is connected with the inner threaded hole of the tube. A space is defined in the adjusting member and a polygonal hole is defined through one end of the adjusting member. The polygonal hole communicates with the space.

A spring is located in the polygonal passage of the tube and the space of the adjusting member. The first end of the spring contacts the inside of the space of the adjusting member.

A first block is located in the room and the polygonal passage of the tube. The second end of the spring contacts the first block. The first block is a polygonal block and has a passage defined therethrough. Multiple first teeth extend from the periphery of the first block.

A second block is located in the room of the tube and engaged with the first block. A tubular portion and a second tubular portion respectively extend from two ends of the second block. The first tubular portion extends through the passage of the first block. The second block has a polygonal passage. Multiple second teeth extend from the periphery of the second block and engaged with the first teeth.

A stop is located in the room of the tube and has a first side thereof contacting one side of the second block. The stop has a stepped hole. A threaded hole is defined in the periphery of the stop and the first bolt is threadedly engaged with the threaded hole. A positioning hole is defined in the periphery of the stop and the second bolt is threadedly engaged with the positioning hole. The resilient plate is fixed to the stop by the first bolt.

At least one disk is located in the room of the tube and contacts the second side of the stop. Multiple engaging teeth extend from the periphery of the at least one disk and the protrusion of the resilient plate is engaged with the engaging teeth. The at least one disk has a polygonal hole and two first pin-holes. Two pins are respectively inserted into the two first pin-holes.

A pushing member is located in the inner threaded portion of the tube and has a polygonal hole and two second pin-holes. The two pins are inserted into the second pin-holes. The pushing member has outer teeth which are threadedly engaged with the inner threaded portion of the tube.

A cap is connected to the second end of the tube and made by electric-insulation material. A polygonal recess is defined in the first end of the cap and multiple digits-and-marks are marked on the outside of the first end of the cap. A polygonal reception recess is defined in the second end of the cap.

A link is located in the polygonal reception recess of the cap and has a polygonal rod which is inserted into the two respective polygonal holes of the at least one disk and the pushing member.

Preferably, the tube is received in the handle of a screwdriver.

Preferably, a fixing hole is defined through the wall of the tube and communicates with the inner threaded hole.

Preferably, a shoulder 18 protrudes from outside of the second end of the tube and an engaging hole is defined through the shoulder. A positioning member has a bent portion which is engaged with the engaging hole.

Preferably, the adjusting member has a first washer and a second washer received therein. The first washer has multiple first ribs extending from one side thereof and the second washer has multiple second ribs extending from one side thereof. The first ribs face the second ribs.

Preferably, each of the first teeth and the second teeth has a vertical face and an inclined face, wherein the two respective inclined faces of the two respective first and second teeth are matched with each other.

Preferably, the cup has multiple positioning holes defined in the outside of the first end thereof. A transparent plate is mounted to the outside of the first end of the cap and has a polygonal recess which is located corresponding to the polygonal recess of the cap. Multiple studs extend from the inside of the transparent plate and are engaged with the positioning holes.

Preferably, the cap has multiple resilient plates extending axially from the first end thereof and each resilient plate has a lip at the distal end thereof. A collar is mounted to the resilient plates and positioned by the lips. The collar has multiple annular protrusions extending therefrom.

Preferably, a polygonal positioning member is located in the polygonal reception recess. The link is shaped to be engaged with the polygonal reception recess. The link has a polygonal recess with which the polygonal positioning member is engaged.

The primary object of the present invention is to provide a torque adjustment device for a screwdriver wherein the value of the torque can be adjusted by rotating the cap on the rear end of the handle, and the parts in the torque adjustment device are not loosened during use.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
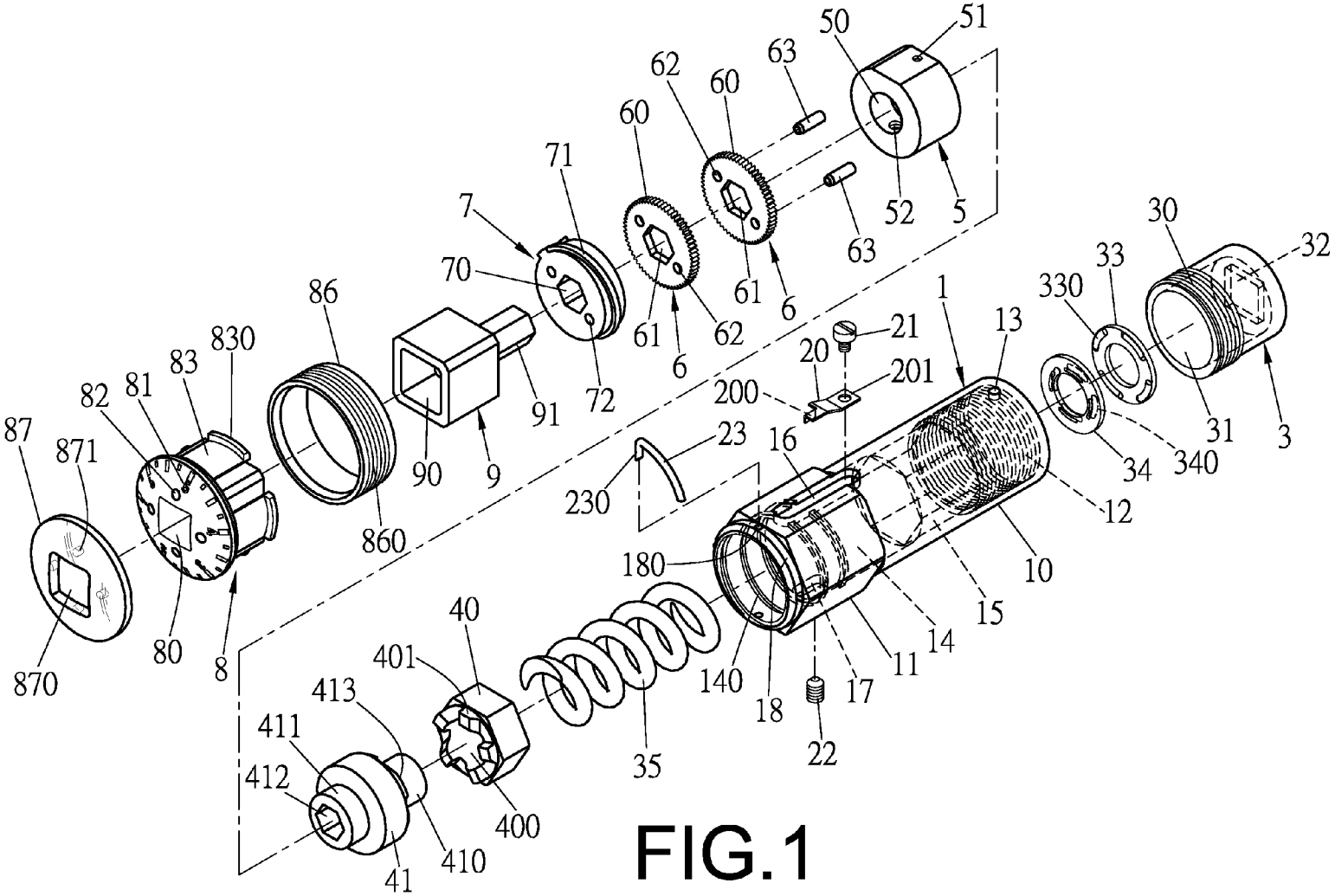
FIG. 1 is an exploded view to show the torque adjustment device of the present invention.
Figure 2:
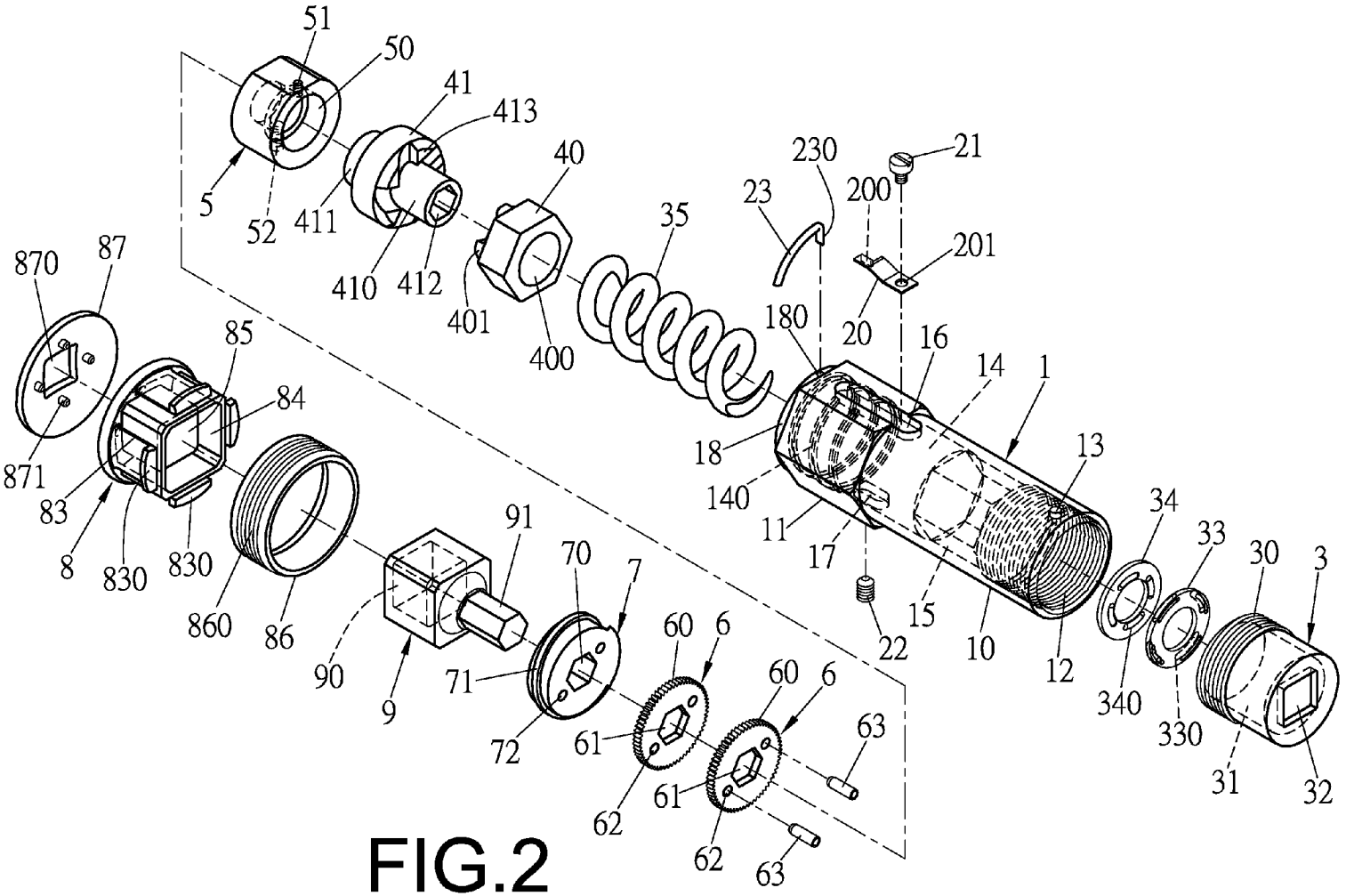
FIG. 2 is another exploded view to show the torque adjustment device of the present invention.

Referring to FIGS. 1 and 2, the torque adjustment device for a screwdriver of the present invention comprises a tube 1 which is a cylindrical portion 10 at the first end thereof, and a polygonal section 11 is formed on outside of the second end of the tube 1. An inner threaded hole 12 defined in the cylindrical portion 10 of the first end of the tube 1 and a fixing hole 13 is defined through the wall of the tube 1 and communicates with the inner threaded hole 12. A room 14 is defined in the polygonal section 11 on the second end of the tube 1 and an inner threaded portion 140 is defined in the inner periphery of room 14. A polygonal passage 15 is defined in the tube 1 and located between the room 14 and the inner threaded hole 12. In this embodiment, the polygonal passage 15 is a hexagonal passage. A first slot 16 and a second slot 17 are respectively defined through the tube 1 and communicate with the room 14. A shoulder 18 protrudes from outside of the second end of the tube 1 and an engaging hole 180 is defined through the shoulder 18. A resilient plate 20 is located in the first slot 16 and a protrusion 200 extends perpendicularly from the first end of the resilient plate 20. A hole 201 is defined through the second end of the resilient plate 20. A first bolt 21 extends through the hole 201 of the resilient plate 20 and a second bolt 22 is located in the second slot 17 of the tube 1. A positioning member 23 has a bent portion 230 which is engaged with the engaging hole 180.

An adjusting member 3 is connected to the first end of the tube 1 and has an outer threaded portion 30 which is connected with the inner threaded hole 12 of the tube 1. A space 31 is defined in the adjusting member 3 and a polygonal hole 32 is defined through one end of the adjusting member 3. The polygonal hole 32 communicates with the space 31. The adjusting member 3 has a first washer 33 and a second washer 34 received therein. The first washer 33 has multiple first ribs 330 extending from one side thereof and the second washer 34 has multiple second ribs 340 extending from one side thereof. The first ribs 330 face the second ribs 340. The first ribs 330 contact the second washer 34 and the second ribs 340 contact the first washer 33.

A spring 35 is located in the polygonal passage 15 of the tube 1 and the space 31 of the adjusting member 3. The first end of the spring 35 contacts the inside of the space 31 of the adjusting member 3. A first block 40 is located in the room 14 and the polygonal passage 15 of the tube 1. The first block 40 is a polygonal block which is shaped to be engaged with the polygonal passage 15. The second end of the spring 35 contacts the first block 40. The first block 4 has a passage 400 defined therethrough. Multiple first teeth 401 extend from the periphery of the first block 40.

A second block 41 is located in the room 14 of the tube 1 and engaged with the first block 40. A tubular portion 410 and a second tubular portion 411 respectively extend from two ends of the second block 41. The first tubular portion 410 extends through the passage 400 of the first block 40. The second block 41 has a polygonal passage 412. Multiple second teeth 413 extend from the periphery of the second block 41 and engaged with the first teeth 401. Each of the first teeth 401 and the second teeth 413 has a vertical face and an inclined face, wherein the two respective inclined faces of the two respective first and second teeth 401, 413 are matched with each other.

A stop 5 is located in the room 14 of the tube 1 and has a first side thereof contacting one side of the second block 41. The stop 5 has a stepped hole 50. A threaded hole 51 is defined in the periphery of the stop 5 and the first bolt 21 are threadedly engaged with the threaded hole 51. A positioning hole 52 is defined in the periphery of the stop 5 and the second bolt 22 is threadedly engaged with the positioning hole 52. The resilient plate 30 is fixed to the stop 5 by the first bolt 21.

At least one disk 6 is located in the room 14 of the tube 1 and contacts the second side of the stop 5. Multiple engaging teeth 60 extend from the periphery of the at least one disk 6 and the protrusion 200 of the resilient plate 20 is engaged with the engaging teeth 60. The at least one disk 6 has a polygonal hole 61 and two first pin-holes 62. Two pins 63 are respectively inserted into the two first pin-holes 62.

A pushing member 7 is located in the inner threaded portion 140 of the tube 1 and has a polygonal hole 70 and two second pin-holes 72. The two pins 63 are inserted into the second pin-holes 72. The pushing member 7 has outer teeth 71 which are threadedly engaged with the inner threaded portion 140 of the tube 1.

A cap 8 is connected to the second end of the tube 1 and made by electric-insulation material. A polygonal recess 80 is defined in the first end of the cap 8 and multiple digits-and-marks 81 are marked on the outside of the first end of the cap 8. A polygonal reception recess 84 is defined in the second end of the cap 8. The cap 1 has multiple positioning holes 82 defined in the outside of the first end thereof. A transparent plate 87 is mounted to the outside of the first end of the cap 1 and has a polygonal recess 870 which is located corresponding to the polygonal recess 80 of the cap 8. Multiple studs 871 extend from the inside of the transparent plate 87 and are engaged with the positioning holes 82. The cap 8 has multiple resilient plates 83 extending axially from the first end thereof and each resilient plate 83 has a lip 830 at the distal end thereof. A collar 86 is mounted to the resilient plates 83 and positioned by the lips 830. The collar 86 has multiple annular protrusions 860 extending therefrom.

A link 9 is located in the polygonal reception recess 84 of the cap 8 and is shaped to be engaged with the polygonal reception recess 84. A polygonal positioning member 85 is located in the polygonal reception recess 84. The link 9 has a polygonal recess 90 with which the polygonal positioning member 85 is engaged. The link 9 has a polygonal rod 91 which is inserted into the two respective polygonal holes 61, 70 of the at least one disk 6 and the pushing member 7.

When assembling, as shown in FIGS. 1 to 4, the first and second washers 33, 34 are installed in the space 31 of the adjusting member 3 and the outer threaded portion 30 of the adjusting member 3 is threadedly connected with the inner threaded hole 12 of the tube 1. The spring 35 is located in the polygonal passage 15 and the space 31, and the first block 40 is installed in the room 14 to allow a part of the first block 40 to be inserted into the polygonal passage 15. The spring 35 is biased between the second washer 34 and the first block 40. The second block 41 is then installed in the room 14 of the tube 1 and the first tubular portion 410 is inserted into the passage 400 of the first block 40. The first teeth 401 are engaged with the second teeth 413. The stop 5 is then installed in the room 14 and contacts the second block 41. The second tubular portion 411 of the second block 41 is inserted into the stepped hole 50 of the stop 5. The second bolt 22 extends through the second slot 17 and is connected to the positioning hole 52 of the stop 5 to restrain the stop 5 in the room 14. The two disks 6 contact one side of the pushing member 7 and the two pins are inserted into the respective pin-holes 62, 72 to connect the disks 6 and the pushing member 7. The combination of the disks 6 and the pushing member 7 is inserted into the room 14 to let the outer teeth 71 engage with the inner threaded portion 140. The disk 6 contacts the stop 5 and the bent portion 230 of the positioning member 23 is inserted into the engaging hole 180 to let the bent portion 230 contact the outside of the pushing member 7 to prevent the pushing member 7 from being disengaged from the tube 1. The resilient plate 20 is installed in the first slot 16 of the tube 1 and the first bolt 21 extends through the hole 201 and is connected with the threaded hole 51 to fix the resilient plate 20 to the stop 5. The protrusion 200 of the resilient plate 20 is resiliently engaged with the engaging teeth 60 of the disks 6. The collar 86 is mounted to the resilient plates 83 of the cap 8 and the transparent plate 87 is mounted to the cap 8. The studs 871 extending from the inside of the transparent plate 87 are engaged with the positioning holes 82 to connect the transparent plate 87 to the cap 8. The link 9 is located in the polygonal reception recess 84 of the cap 8 and is shaped to be engaged with the polygonal reception recess 84. Both of the cap 8 and the link 9 are installed in the second end of the tube 1. The polygonal rod 91 is inserted into the two respective polygonal holes 61, 70 of the disks 6 and the pushing member 7, and the stepped hole 50 of the stop 5 to complete the assembly.

Figure 3:
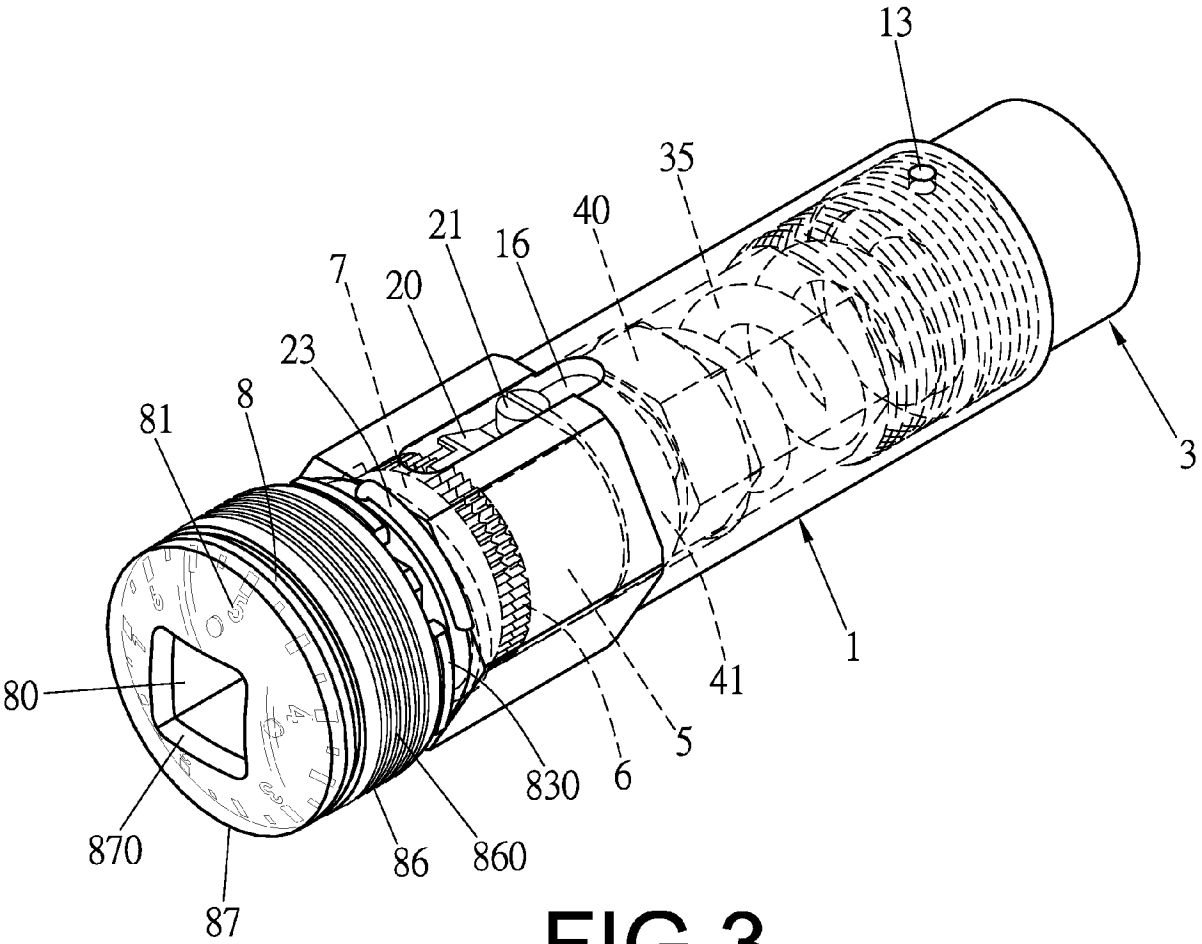
FIG. 3 is a perspective view to show the torque adjustment device of the present invention.
Figure 4:
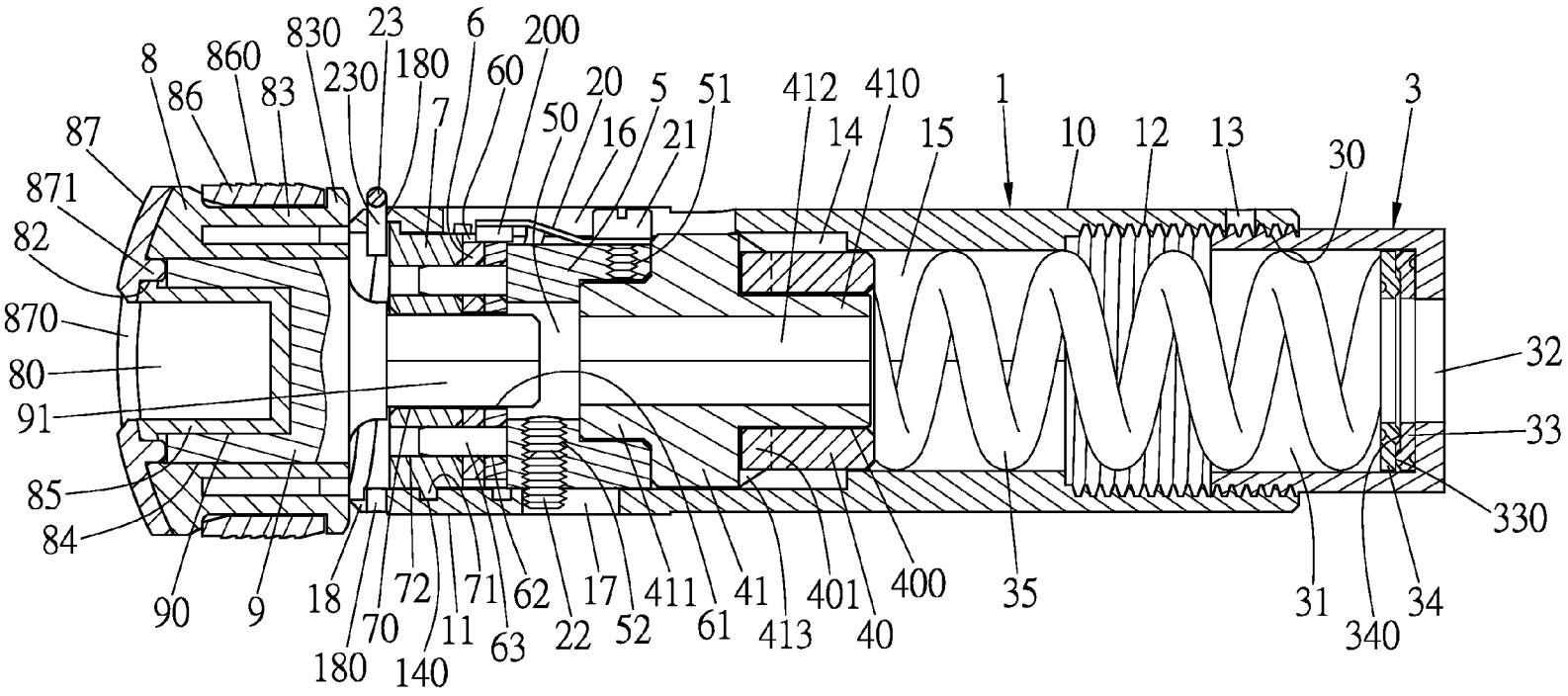
FIG. 4 is a cross sectional view of the torque adjustment device of the present invention.
Figure 5:
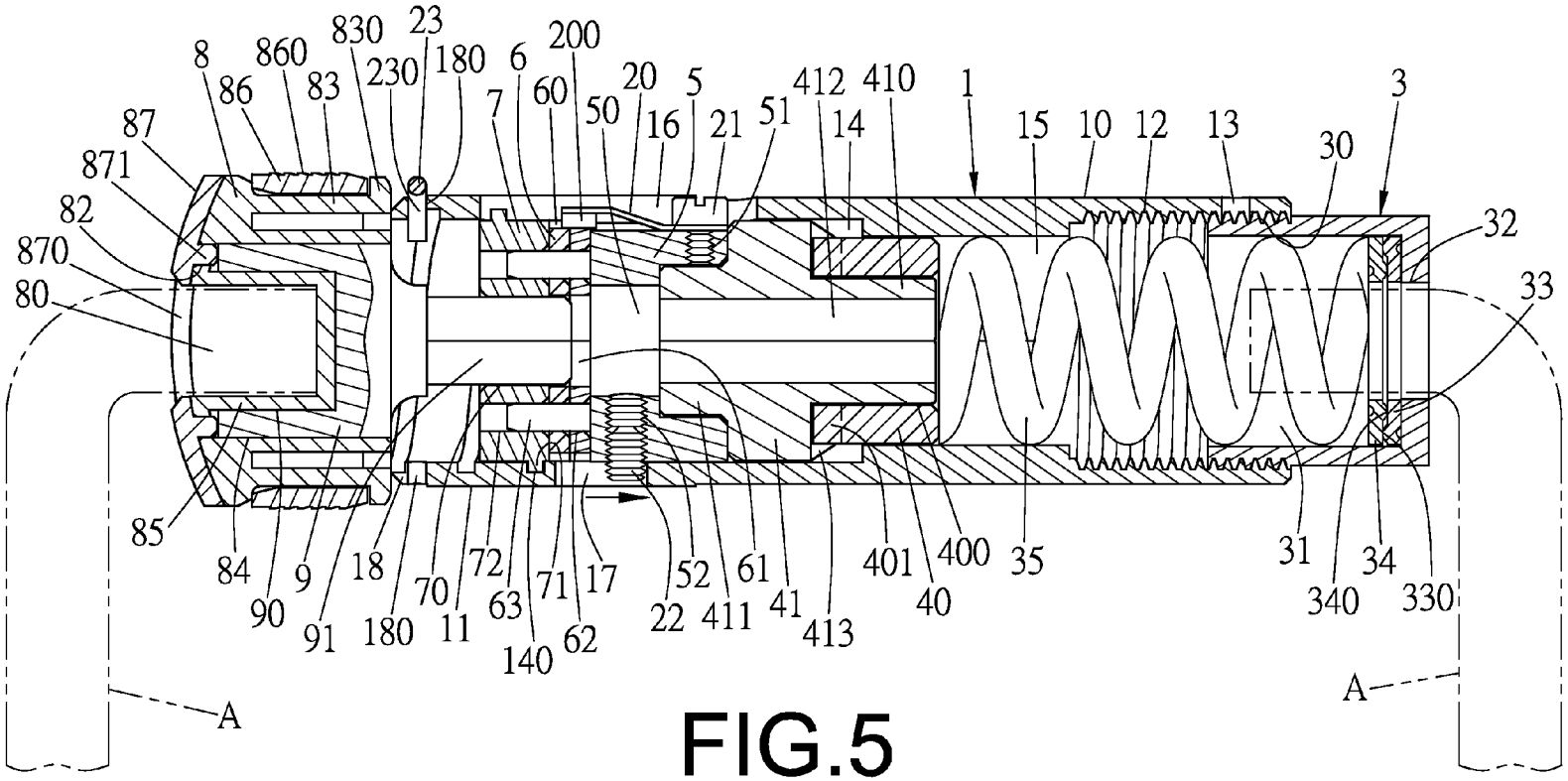
FIG. 5 is a cross sectional view to show the adjustment action of the torque adjustment device of the present invention.
Figure 6:
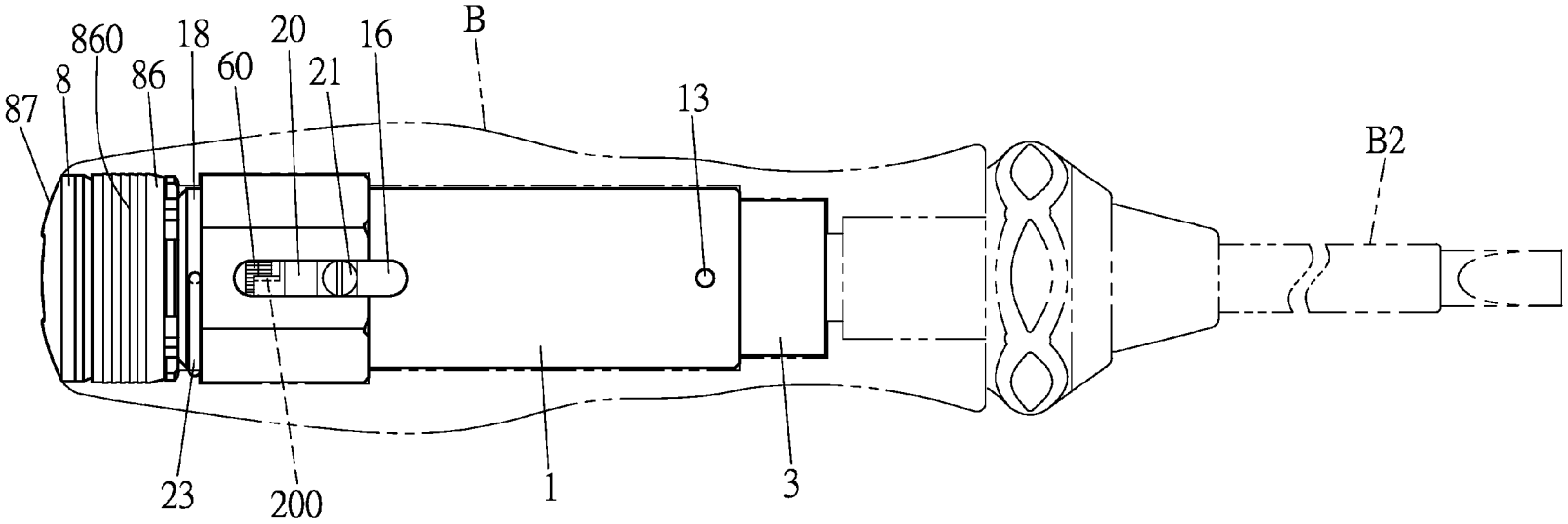
FIG. 6 shows that the torque adjustment device of the present invention is received in the handle of a screwdriver.
Figure 7:
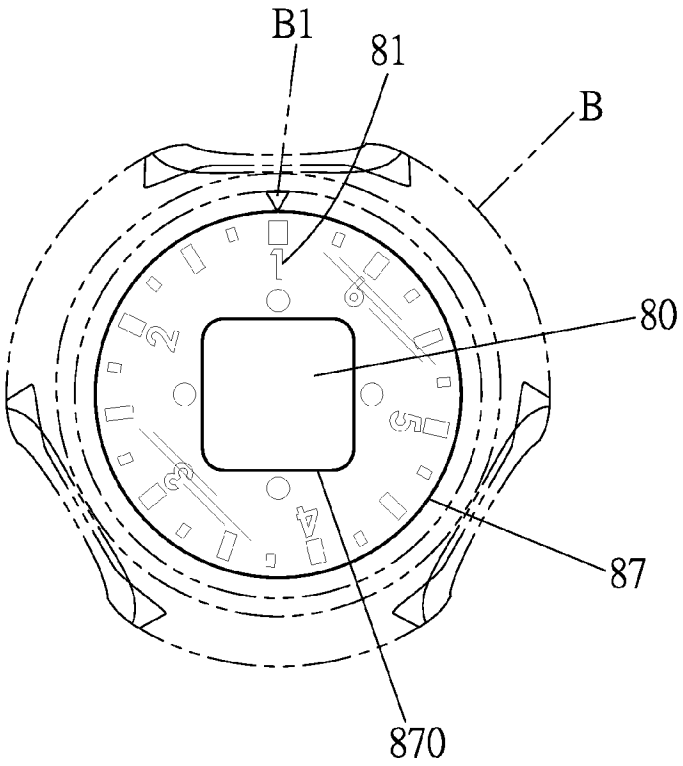
FIG. 7 is an end view to show the cap and the handle of the screwdriver.

As shown in FIGS. 3 to 5, when in use, the torque is adjusted and set by using an assistance tool "A" which is inserted into the polygonal recess 80 of the cap 8, the cap 8 is rotated by rotating the assistance tool "A". The link 9 is rotated by the cap 8 and the pushing member 7 is rotated by the link 9. The pushing member 7 is moved forward or backward in the tube 1 due to the engagement between the outer teeth 71 and the inner threaded portion 140. When a large torque is to be set, the pushing member 7 is moved and rotates the disks 6 which push the stop 5 toward the first end of the tube 1. The protrusion 200 moves over the engaging teeth 60 of the disks 6. When the stop 5 pushes the second block 41 more snugly toward the first block 40, the first block 40 is pushed by the spring 35 so that the force between the first and second teeth 401, 413 is increased. The torque is set to be larger as shown in FIG. 5. When a smaller torque is to be set, the pushing member 7 is moved toward the second end of the tube 1, the stop 5, the first and second blocks 40, 41 are moved toward the second end of the tube 1. The force between the first and second teeth 401, 413 is decreased. The torque is set to be smaller as shown in FIG. 4.

The range of the torque to be set is restricted within the distance that the stop 5 moves, and the distance that the stop 5 moves is limited within the distance that the second bolt 22 being moved in the second slot 17 of the tube 1. Alternatively, the torque can also be adjusted and set by using the assistance tool "A" which is inserted into the polygonal hole 32 of the adjusting member 3. The adjusting member 3 is rotated to compress the spring 35 in the tube 1. When the force of the spring 35 is adjusted by rotating the adjusting member 3, the fixing hole 13 is sealed. The adjusting member 3 is in a stable status in the tube 1 by the first and second washers 33, 34. When a larger torque is set, the larger digit on the cap 8 is pointed to the corresponding mark "B1" on the handle "B", vice versa. The torque adjustment device is accommodated in the handle "B", the annular portions 860 on the collar 86 are securely connected with the handle "B" to ensure that the torque adjustment device is well positioned in the handle "B".

Figure 8:
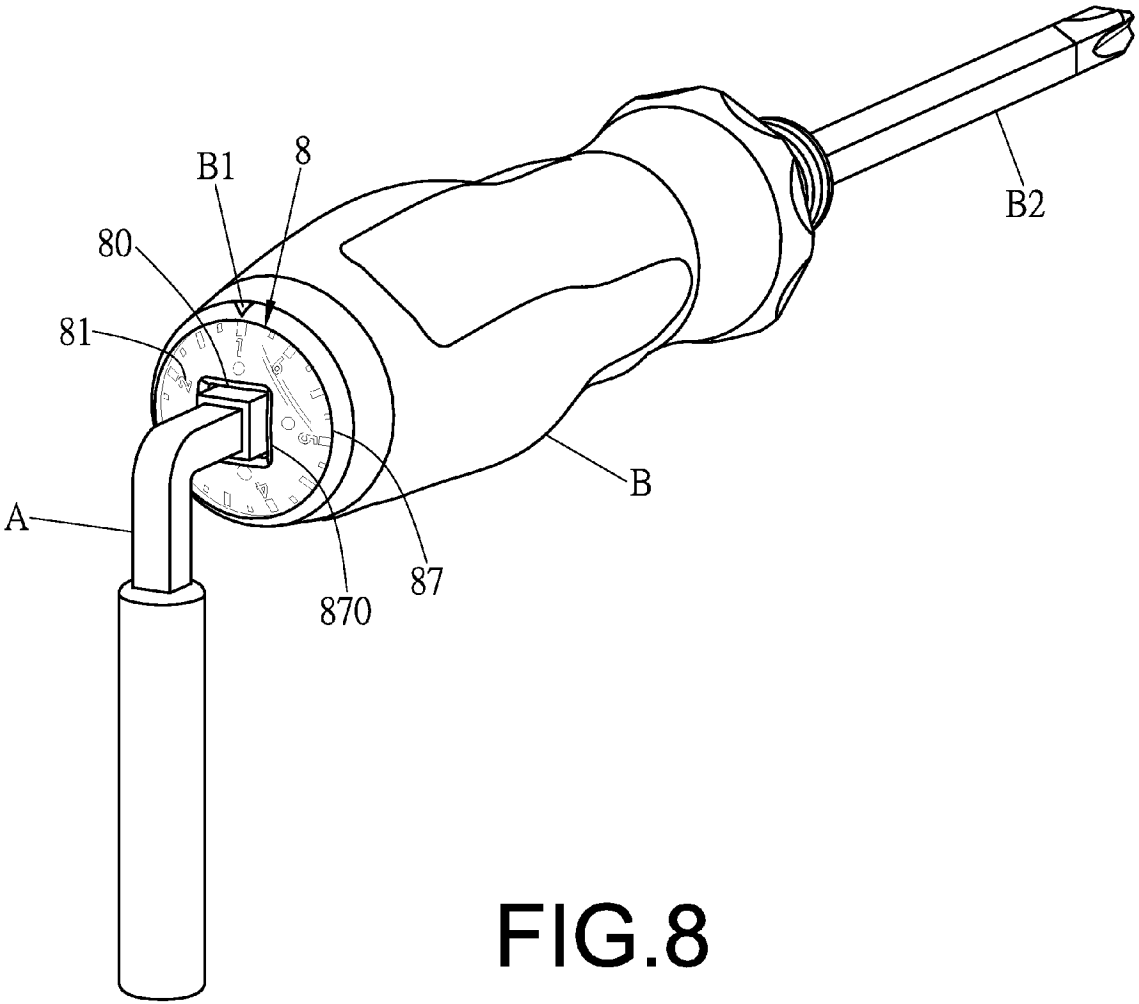
FIG. 8 shows that assistance tool is used to adjust the torque of the torque adjustment device of the present invention.

When in use, as shown in FIGS. 3 to 8, the handle "B" is cooperated with different types of bits "B2" such as the keystone tip, the Phillips head tip, and the square tip. The torque is adjusted and set by inserting the assistance tool "A" into the polygonal recesses 80, 870 of the cap 8 and the transparent plate 87 as shown in FIG. 8, the assistance tool "A" is rotated to rotate the transparent plate 87, the digits-and-marks 81 on the cap 8 is moved to align with the marks "B1" of the handle "B" to set the torque. The digits-and-marks 81 on the cap 8 are convenient for setting the torque of the users and can be protected from being worn out by the transparent plate 87. By the protrusion 200 of the resilient plate 20 with the engaging teeth 60 of the disks 6, the vibration due to the engagement between the first teeth 400 and the second teeth 413 of the first and second blocks 40, 41 can be handled so that the parts of n the device are no loosened. The first and second washers 33, 34 are used to depress the vibration and to prevent the adjusting member 3 from being loosened, while the set torque is precisely output.

While we have shown and described the embodiment in accordance with the present invention, it should be clear to those skilled in the art that further embodiments may be made without departing from the scope of the present invention.

What is claimed is:

1. A torque adjustment device for a screwdriver, comprising:

a tube having an inner threaded hole defined in a first end thereof, a room defined in a second end of the tube, the tube having an inner threaded portion defined in an inner periphery thereof, a polygonal passage defined in the tube and located between the room and the inner threaded hole, a first slot and a second slot respectively defined through the tube and communicating with the room;

a resilient plate located in the first slot and a protrusion extending angularly from a first end of the resilient plate, a hole defined through a second end of the resilient plate, a first bolt extending through the hole of the resilient plate, a second bolt located in the second slot of the tube;

an adjusting member connected to the first end of the tube and having an outer threaded portion which is connected with the inner threaded hole of the tube, a space defined in the adjusting member and a polygonal hole defined through an end of the adjusting member, the polygonal hole communicating with the space;

a spring located in the polygonal passage of the tube and the space of the adjusting member, a first end of the spring contacting an inside of the space of the adjusting member;

a first block located in the room and the polygonal passage of the tube, a second end of the spring contacting the first block, the first block being a polygonal block and having a passage defined therethrough, multiple first teeth extending from a periphery of the first block;

a second block located in the room of the tube and engaged with the first block, a first tubular portion and a second tubular portion respectively extending from two ends of the second block, the first tubular portion extending through the passage of the first block, the second block having a polygonal passage, multiple second teeth extending from a periphery of the second block and engaged with the first teeth;

a stop located in the room of the tube and having a first side thereof contacting one side of the second block, the stop having a stepped hole, a threaded hole defined in a periphery of the stop and the first bolt threadedly engaged with the threaded hole, a positioning hole defined in the periphery of the stop and the second bolt threadedly engaged with the positioning hole, the resilient plate fixed to the stop by the first bolt;

at least one disk located in the room of the tube and contacting a second side of the stop, multiple engaging teeth extending from a periphery of the at least one disk and the protrusion of the resilient plate engaged with the engaging teeth, the at least one disk having a polygonal hole and two first pin-holes, two pins respectively inserted into the two first pin-holes;

a pushing member located in the inner threaded portion of the tube 1 and having a polygonal hole and two second pin-holes, the two pins inserted into the second pin-holes, the pushing member having outer teeth which are threadedly engaged with the inner threaded portion of the tube;

a cap connected to the second end of the tube and being made by electric-insulation material, a polygonal recess defined in a first end of the cap and multiple digits-and-marks being marked on an outside of the first end of the cap, a polygonal reception recess defined in a second end of the cap, and a link located in the polygonal reception recess of the cap and having a polygonal rod which is inserted into the two respective polygonal holes of the at least one disk and the pushing member.

2. The device as claimed in claim 1, wherein the tube is adapted to be received in a handle of a screwdriver.

3. The device as claimed in claim 1, wherein a fixing hole is defined through a wall of the tube and communicates with the inner threaded hole.

4. The device as claimed in claim 1, wherein a shoulder protrudes from outside of the second end of the tube and an engaging hole is defined through the shoulder, a positioning member has a bent portion which is engaged with the engaging hole.

5. The device as claimed in claim 1, wherein the adjusting member has a first washer and a second washer received therein, the first washer has multiple first ribs extending from one side thereof and the second washer has multiple second ribs extending from one side thereof, the first ribs face the second ribs.

6. The device as claimed in claim 1, wherein each of the first teeth and the second teeth has a vertical face and an inclined face, the two respective inclined faces of the two respective first and second teeth are matched with each other.

7. The device as claimed in claim 1, wherein the cap has multiple positioning holes defined in the outside of the first end thereof, a transparent plate is mounted to the outside of the first end of the cap, the transparent plate has a polygonal recess which is located corresponding to the polygonal recess of the cap, multiple studs extend from an inside of the transparent plate and engaged with the positioning holes.

8. The device as claimed in claim 1, wherein the cap has multiple resilient plates extending axially from the first end thereof and each resilient plate has a lip at a distal end thereof, a collar is mounted to the resilient plates and positioned by the lips, the collar has multiple annular protrusions extending therefrom.

9. The device as claimed in claim 1, wherein a polygonal positioning member is located in the polygonal reception recess, the link is shaped to be engaged with the polygonal reception recess, the link has a polygonal recess with which the polygonal positioning member is engaged.

* * * * *